US005858130A

United States Patent [19]

Bodnar et al.

[11] Patent Number: 5,858,130

[45] Date of Patent: Jan. 12, 1999

[54] COMPOSITION AND METHOD FOR PRODUCING AN ALLOY STEEL AND A PRODUCT THEREFROM FOR STRUCTURAL APPLICATIONS

[75] Inventors: Richard L. Bodnar; Yulin Shen, both of Bethlehem, Pa.

[73] Assignee: Bethlehem Steel Corporation, Del.

[21] Appl. No.: 883,470

[22] Filed: Jun. 25, 1997

[51] Int. Cl.[6] ..... C22C 38/16

[52] U.S. Cl. ..... 148/332; 420/120

[58] Field of Search ..... 420/8, 120, 126, 420/127, 128; 148/332

[56] References Cited

U.S. PATENT DOCUMENTS

| | | | |
|---|---|---|---|
| 3,902,927 | 9/1975 | Pernstal | 148/12 F |
| 3,947,293 | 3/1976 | Takechi et al. | 148/12 F |
| 4,494,999 | 1/1985 | Graf | 148/2 |
| 4,572,748 | 2/1986 | Suga et al. | 148/12 F |
| 4,915,901 | 4/1990 | Shimada et al. | 420/119 |
| 5,326,527 | 7/1994 | Bodnar et al. | 420/126 |
| 5,454,883 | 10/1995 | Yoshie et al. | 148/320 |
| 5,507,886 | 4/1996 | Bodnar et al. | 148/541 |
| 5,514,227 | 5/1996 | Bodnar et al. | 148/541 |

FOREIGN PATENT DOCUMENTS

| | | |
|---|---|---|
| 3012139 | 10/1980 | Germany . |
| 54-066321 | 5/1979 | Japan . |
| 55-011104 | 1/1980 | Japan . |
| 58-171526 | 10/1983 | Japan . |
| 59-83722 | 5/1984 | Japan . |
| 59-211528 | 11/1984 | Japan . |
| 59-222528 | 12/1984 | Japan . |
| 60-067621 | 4/1985 | Japan . |
| 63-128117 | 5/1988 | Japan . |
| 01275719 | 11/1989 | Japan . |
| 08197103 | 8/1996 | Japan . |

*Primary Examiner*—Sikyin Ip
*Attorney, Agent, or Firm*—Harold I. Masteller, Jr.

[57] ABSTRACT

A high strength low-alloy steel is subjected to a controlled rolling and accelerated cooling process to obtain minimum physical properties while achieving improved mill productivity. The alloy chemistry utilizes a low silicon, carbon, niobium, vanadium, titanium-containing steel composition which is hot worked and accelerated cooled under controlled conditions. The chemistry, controlled rolling and accelerated cooling allows for significant increase in the finishing rolling temperature thereby permitting high rolling output. The alloy chemistry includes a low-carbon grade which also has improved castability, formability and weldability.

8 Claims, 7 Drawing Sheets

COMPOSITION AND METHOD FOR PRODUCING AN ALLOY STEEL AND A PRODUCT THEREFROM FOR STRUCTURAL APPLICATIONS

FIELD OF THE INVENTION

The present invention is directed to a composition and a method of producing alloy steels for structural applications and a structural steel product. In particular, the method includes continuous casting, controlled hot rolling and accelerated cooling of a low-silicon, titanium, niobium and vanadium-containing steel to produce a rolled product which has good mechanical properties and allows for improved manufacturing productivity.

BACKGROUND ART

Low-alloy steels are commonly used for structural applications in shapes such as plates, bars, pilings, pipe and the like. Low-alloy steels are selected for such structural applications because they have good mechanical and physical properties, they are generally low in cost, and they have a high degree of versatility. The properties of such steels can be varied by either adjusting the alloying elements and/or altering the processing steps used to manufacture the steel into a final form. Typical final form applications for these types of steels include poles, ships, linepipe and other similar structural applications.

ASTM Designation A572/A572M is one standard for low-alloy steels containing niobium and vanadium. This specification sets an alloy content range, in weight percent, of up to 0.23% carbon, up to 1.65% manganese, up to 0.04% phosphorus, up to 0.05% sulfur, up to 0.40% silicon, up to 0.05% niobium, between 0.01 and 0.15% vanadium and up to 0.015% nitrogen with the balance iron and inevitable impurities. For grade 65 of this specification (generally of higher carbon and microalloy contents), the minimum yield strength is 65 ksi (450 MPa) and the minimum tensile strength is 80 ksi (550 MPa).

Subsequent to the development of the original ASTM A572 steel (a higher C—V grade), another alloy was developed containing lower amounts of carbon with vanadium and the addition of niobium (C—Nb—V). This steel permitted relaxation of the processing variables while still achieving the desired mechanical properties. One drawback associated with the C—Nb—V steel was the difficulty in achieving Charpy V-Notch toughness values. Pole manufacturers generally require a minimum longitudinal Charpy V-Notch (CVN) toughness of 15 foot-pounds (20.3 Joules) at −20° F. (−29° C.). To meet this requirement, reheating temperatures of the slab to be hot rolled were restricted to minimize austenite grain growth.

With a need to further improve the properties of the C—Nb—V alloy steels, a titanium-containing grade was developed (C—Nb—V—Ti). With the small addition of titanium, a fine dispersion of titanium nitride particles forms during cooling after solidification in a continuous caster. The particles restrict austenite grain growth during reheating and subsequent recrystallization steps. Consequently, the C—Nb—V—Ti grade is expected to be less sensitive to reheating temperatures, thereby providing more flexibility in the manufacturing process. For the titanium nitride technology to be particularly effective, the size of the titanium nitride particles should be small, this size being possible when the slab is produced by continuous casting.

Products produced from the C—Nb—V—Ti grade are generally air cooled after hot rolling. Although this grade exhibits superior levels of toughness than the C—Nb—V grade, meeting the ASTM A572 Grade 65 specifications for yield and tensile strengths requires precise processing controls to minimize off specification material. Such controls ultimately increase the overall costs of the product and manufacturing operation.

Consequently, a need has developed to improve the manufacturing process of these types of low-alloy steels in terms of productivity while still maintaining the minimal mechanical properties required, e.g., yield strength, tensile strength and CVN toughness. The present invention solves this need by providing a low-silicon steel containing controlled amounts of titanium, niobium, vanadium and carbon. The low-alloy steel is subjected to a controlled rolling and accelerated cooling sequence to produce a rolled product meeting minimal mechanical properties while providing for significant improvements in mill productivity.

In the prior art, the use of accelerated cooling of low-alloy steels has been disclosed. Japanese Publication No. 59-83722 to Kawasaki Steel discloses low-carbon steel plates produced by heating a slab comprising, among other alloying elements, silicon, niobium, boron and titanium. This steel is hot rolled and immediately subjected to forced cooling to a temperature lower than 500° C. at a cooling rate of 2°–30° C. per second.

Japanese Publication No. 59-22528 to Sumitomo Metal Industries discloses another process of producing a rolled high-strength steel plate wherein the steel includes carbon, silicon, manganese, aluminum, vanadium, nitrogen and one of zirconium, a rare earth metal and calcium. The steel is continuously cast into a slab, hot rolled and accelerated cooled to below 250° C. followed by coiling.

Japanese Publication No. 59-211528 to Nippon Steel Corporation discloses a low yield ratio for a steel containing carbon, 0.05 to 0.60 wt. % silicon, manganese, aluminum and at least one of chromium, nickel, molybdenum, vanadium, titanium, niobium, copper and calcium. The hot rolled steel is rapidly cooled with water and then tempered.

U.S. Pat. No. 5,514,227 to Bodnar et al. also teaches the accelerated cooling of a low-alloy steel. Bodnar et al. are concerned with a steel that has a minimum yield strength of 50 ksi and one that contains carbon, manganese, phosphorus, silicon, titanium, nitrogen and vanadium with the balance iron.

None of the prior art discussed above teaches the inventive method wherein a low-alloy steel containing controlled amounts of silicon, carbon, vanadium, titanium and niobium is subjected to a controlled rolling and accelerated cooling sequence to improve rolling productivity while maintaining mechanical properties. The product made from the process of the present invention as well as a composition for use in the process are also not disclosed in the prior art discussed above.

SUMMARY OF THE INVENTION

Accordingly, it is a first object of the present invention to provide an improved method of making structural grade plate or as-rolled products.

Another object of the present invention is a method of making plate products allowing for improved manufacturing productivity while still maintaining acceptable minimal mechanical properties.

A still further object of the invention is a plate product having a yield strength of at least 65 ksi (450 MPa) and a tensile strength of at least 80 ksi (550 MPa) when practicing the method of the present invention.

Yet another object of the present invention is a low-alloy steel composition having controlled amounts of carbon, vanadium, titanium, silicon and niobium which is more easily cast as part of the plate making method of the present invention, and provides improved formability, strength/toughness balance and weldability.

Other objects and advantages of the present invention will become apparent as a description thereof proceeds.

In satisfaction of the foregoing objects and advantages, the present invention provides an improved low-alloy steel composition, a method of producing a plate product by continuous casting, control rolling and accelerated cooling a low-alloy steel and a plate product from such processing. In one aspect, the new method is an improvement over the known process of providing a low-alloy steel which is cast, either batch or continuously, control rolled and air cooled to produce a rolled product. In these prior art methods, the alloy steel typically contains carbon, manganese, phosphorus, sulfur, silicon, nitrogen, aluminum, vanadium, titanium and niobium with the balance iron and incidental impurities. According to the invention, the alloy steel to be processed comprises, in weight percent, silicon being less than 0.04%, titanium being between about 0.006 and 0.020%, aluminum being between 0.005 and 0.08%, vanadium being between about 0.05 and 0.10%, niobium being between about 0.01 and 0.05% and carbon being between about 0.06 and 0.14%. The manganese can range between 1.00 and 2.00, the maximum for phosphorus is 0.03%, the maximum for sulfur is 0.02%, the maximum for nitrogen is 0.012% and the balance is iron and inevitable impurities.

The alloy steel, after being continuously cast, is control rolled to final thickness at a target finish or discontinue rolling temperature where the control rolling is discontinued. The final thickness control rolled product is then subjected to accelerated cooling to a finish cooling temperature, whereby the discontinue rolling temperature of the controlled rolling step is at least about 50° F. higher than the finish rolling temperature of a conventionally processed alloy steel, while the plate product still has a minimum of 65 ksi yield strength. The plate product can then be formed into any known shape or structure, e.g., a pole, linepipe, ship components or any other known or contemplated uses.

Prior to controlled rolling, the continuously cast form can be reheated, preferably, between about 2100° F. (1149° C.) and 2350° F. (1288° C.). With the alloy steel composition of the invention, the reheating temperature is not as sensitive as with prior art alloys.

Preferably, the discontinue rolling temperature ranges between 1400° F. (760° C.) and 1675° F. (912° C.). The finish cooling temperature of the accelerated cooling step ranges between 850° F. (454° C.) and 1200° F. (649° C.). A more preferred minimum finish cooling temperature is at least about 975° F. (524° C.) and a more preferred range is between about 1015° F. (546° C.) and 1050° F. (566° C.).

The controlled rolling sequence is performed such that, when the partially-rolled slab is transferred to the finishing stand, a T/F ratio (transfer thickness to the finished plate thickness) ranges between about 2.0 to 6.0. The percent reduction of the plate (plate reduction from a partially rolled thickness at an intermediate temperature to a finish product thickness at a discontinue rolling temperature) is in a range between about 45 to 75%, more preferably, 50 to 70%.

The accelerated cooling involves the application of moderate water cooling applied to plates immediately after finish rolling. Start cooling temperature, cooling rate, and finish cooling temperature are controlled in the process. For example, the cooling process is normally used in conjunction with hot rolling or controlled rolling on a plate mill to produce "refined" as-rolled microstructures, and the process is carried out by spraying water, or a mixture of water and air, on the top and bottom surfaces of the plate.

In another aspect of the invention, the composition of the alloy steel is further controlled to not only achieve the improved manufacturing productivity and minimum mechanical properties, but also improved castability, weldability and formability. More specifically, the carbon content is controlled so that it avoids the low end of the peritectic regime, i.e., about 0.10% by weight. More preferably, the carbon ranges between 0.06 and less than 0.10%. For plate products ranging from 0.75 to 1.25" (19–31.75 mm), the finishing steps of the hot rolling process can be initiated at about 1950° F. (1065° C.) or less, the finish discontinue temperature can range between 1400° F. (760° C.) and 1650° F. (899° C.), with the total reduction in percent measured when the plate is at or below an intermediate rolling temperature being about 45 to 75%. When the final thickness plate is about 0.4 to 0.6" thick (10–15 mm), the finishing portion of hot rolling can be initiated at about 1975° F. (1079° C.) or less, the finish hot rolling temperature range between 1500° F. (816° C.) and 1625° F. (885° C.) with the total reduction ranging about 45 and 75% as measured from the intermediate hot rolling temperature.

In a still further aspect of the invention, the new method produces a plate product meeting the minimum mechanical property requirements of ASTM A572/A572M. More specifically, the plate product has a minimum yield strength of 65 ksi (450 MPa) and a minimum tensile strength of 80 ksi (550 MPa). The plate product can have any thickness meeting such a specification, exemplary thicknesses ranging from below 0.5" (12.7 mm) to more than 1" (25.4 mm) thick.

Although controlled rolling is disclosed to form a plate product, any controlled deformation to form a hot rolled shape can be utilized with the inventive processing. For example, plates, bars, flanged members, members having an irregular cross section such as I-beams or any other known or contemplated shapes can be formed by hot working.

Continuous casting is necessary for the inventive method to achieve the rapid post-solidification cooling rate needed to produce a fine dispersion of TiN particles for grain refinement.

DESCRIPTION OF THE PREFERRED EMBODIMENTS

Figure 1A:
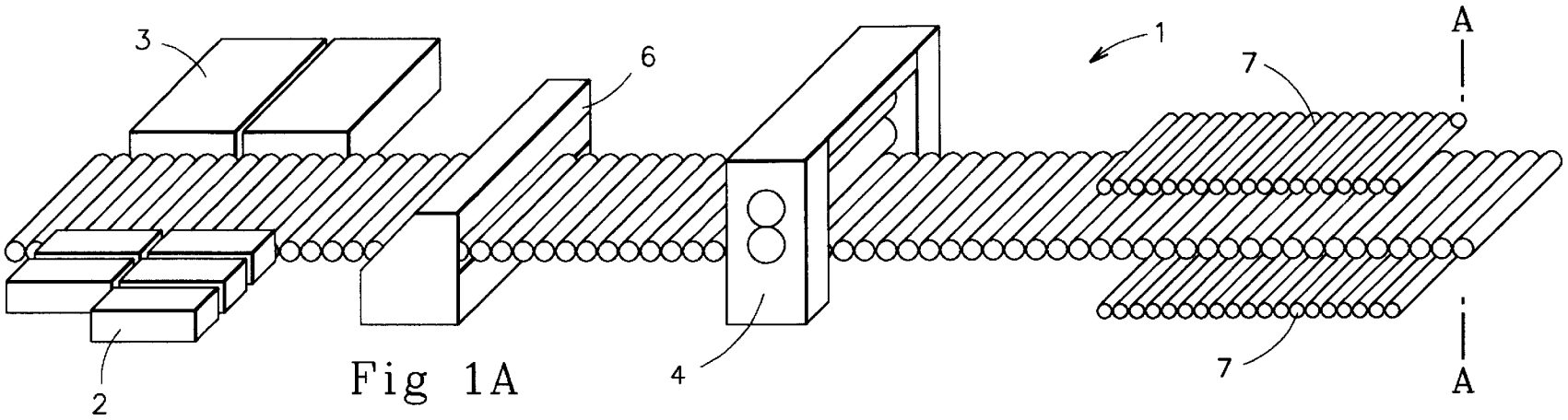
FIG. 1A is a schematic drawing showing a portion of a typical hot rolling mill capable of manufacturing plate product according to the steps of the invention.

The present invention provides a significant improvement over prior art processing techniques for producing structural grade high-strength low-alloy steels. In these prior art techniques, a structural grade alloy composition is cast, either continuously or batch, into a cast shape such as an ingot or slab. The cast shape is then control rolled or worked to a plate or another shape and air cooled. Examples of these types of structural grade materials are found in ASTM specification A572/A572M.

The present invention produces a rolled product which meets the minimum mechanical properties for the ASTM specification, Grade 65, noted above at increased productivity levels. These improvements are achieved by controlling the alloy chemistry and the rolling practice and the use of accelerated cooling. This control/use allows for the completion of hot rolling at a higher temperature than used in present day techniques. By finishing the controlled rolling at a higher temperature, throughput through the rolling mill is significantly higher, e.g., 20 to 35%. This improved throughput results in significant savings in operating costs making both the processing and the rolled product economically attractive.

The rolled product of the invention, preferably, a plate product, is adapted for any structural applications such as bars, bolted construction, bridges, buildings, plates, sheet piling, welded construction, pole-building, ship building, linepipe or the like. The dimensions of the rolled product can vary depending on its application. For example, for plate corresponding to the ASTM Designation A572/A572M, Grade 65, the maximum product thickness is 1¼" (32 mm). Maximum thicknesses can range up to 6" (152.4 mm) for different grades in this specification.

As stated above, the present invention is particularly adapted as a substitute for current grades/products corresponding to the ASTM A572/A572M standard. For Grade 65, this standard sets a minimum of 65 ksi (450 MPa) yield strength and 80 ksi (550 MPa) tensile strength.

The invention also has aspects in alloy chemistry, casting and rolling practices and accelerated cooling. In the alloy chemistry aspect, the invention provides an alloy composition which is less sensitive to slab reheating temperatures when the slabs are reheated prior to hot rolling. The alloy chemistry also provides good formability, weldability, castability and improved strength and toughness over prior art grades.

Table 1 depicts two alloy chemistries that attain desired metallurgical properties when control rolled according to the steps of the present invention, i.e., Alloy 63 and Alloy 63M. These alloys are contrasted with the compositional ranges for the ASTM A572-65 Grade standard, a high carbon vanadium alloy steel (high C—V), a carbon-niobium-vanadium containing steel (C—Nb—V) and a carbon-niobium-vanadium-titanium steel (C—Nb—V—Ti).

Alloy 63, when processed according to the invention, permits improved mill productivity while still meeting the minimum mechanical properties for the ASTM A572-65 Grade standard.

Alloy 63M (the lower-carbon content alloy) is a more preferred alloy chemistry for the inventive processing since it avoids the low end of the peritectic regime (about 0.10%). With lower carbon in Alloy 63M, it is expected to be more castable, i.e., no peritectic cracking is anticipated. In addition, improved strength/toughness balance is expected as are improved formability and weldability.

For effective use of titanium nitride technology, it is preferred that the Alloys 63 and 63M are continuously cast. Continuous casting provides a high post solidification cooling rate desired for the formation of a fine dispersion of titanium nitride particles. The fine titanium nitride particles can restrict austenite grain growth during reheating and after each austenite recrystallization step during the roughing stages of rolling. As shown in Table 1, the titanium content ranges between 0.006 and 0.020%. The target is between 0.010 and 0.014% with an aim of 0.012%. A titanium level of less than about 0.006% will lead to the formation of too few titanium particles which will be ineffective for restricting austenite grain growth. A titanium content greater than about 0.02% will lead to coarser titanium nitride particles, which will be ineffective for restricting austenite grain growth. It should be noted that the titanium/nitrogen weight ratio should be less than the stoichiometric ratio of 3.4:1 (i.e., there should be excessive nitrogen) to minimize titanium nitride particle coarsening during slab reheating.

Nitrogen is restricted to less than 0.012%. Any excess nitrogen after TiN formation will form Nb,V(C,N) particles. Effective use of titanium nitride technology is also expected to improve heat-affected-zone toughness (weldability) due to the grain refinement imparted by the stable titanium nitride particles.

Silicon in the alloy chemistries is kept to less than 0.04% by weight for good adherence of any subsequently applied galvanized coating. The low level of silicon may also provide other benefits to the steel such as improved cleanliness (less silicate inclusions), improved plate surface condition (eliminate the formation of the low melting point phase fayalite in the scale), and improved weldability (possibly of interest in linepipe applications where the carbon equivalent is often restricted).

Vanadium and niobium are added to precipitate as Nb,V (C,N) particles in the austenite, starting at about 1800° F. (982° C.) during rolling. These initial particles retard austenite recrystallization. Any deformation of the austenite below about 1800° F. (982° C.) (in the finishing stand of a plate mill) will cause the austenite grains to flatten and create microstructural defects such as deformation bands, twin boundaries and dislocation cells. Each of these microstructural defects serve as ferrite nucleation sites, thereby leading to ferrite grain refinement. The use of the accelerated cooling through the ferrite transformation further serves to refine the ferrite grain size. Additional Nb,V (C,N) particles can form in the ferrite during either the austenite-to-ferrite transformation or thereafter, strengthening the ferrite by the mechanism of precipitation strengthening.

Manganese is added to steel to tie up sulfur as MnS and to provide strength. A manganese to sulfur ratio of at least 20:1 is required to tie up the sulfur content. Accordingly, in a steel with a 0.020% sulfur content, at least 0.40% Mn is required to avoid hot shortness due to iron sulfide formation. Manganese also provides strengthening through solid-solution strengthening, through microstructure refinement by lowering the transformation temperature for ferrite, pearlite, bainite and martensite formation, and by increasing hardenability (thereby providing transformation strengthening). Increasing strengthening increments are obtained by these mechanisms as the manganese content is increased. However, steels with Mn levels above about 1.65% are susceptible to positive mid-section segregation during solidification and can cause martensite streaks along the mid-section of the finished plate product. Additionally, steels that contain manganese in amounts ranging between 1.0 to 1.40% by weight tend to meet necessary ASTM mechanical property requirements when produced in thin sections, that is, sections measuring up to about 0.5 inches in thickness. However, the 1.0 to 1.40% range is inadequate for producing the necessary ASTM mechanical properties in thicker cast sections. Therefore, in order to meet ASTM standards in thicker cast sections, the manganese content for the preferred alloy of the present invention is within a range of about 1.40 to 1.60% Mn by weight.

The aluminum is added in an amount to fully kill the steel as is known in the art. The range is between 0.005 and 0.08% by weight with a preferred range of 0.02 to 0.04% aluminum.

The alloy chemistry described above must be continuously cast into a shape such as a slab, bar or the like. The continuously cast shape, e.g., a slab, can then be reheated and control rolled and subjected to accelerated cooling to manufacture the improved plate product of the invention.

The low-carbon alloy chemistry of Alloy 63M is preferred since it is believed to improve the continuous casting by reason of its avoidance of the peritectic regime. Thus, the alloy chemistry's carbon content is controlled to be less than about 0.10% wt. A further description of the casting techniques for these types of materials is well known and does not require further explanation for understanding of the invention.

Once the material is continuously cast, it can be directly control rolled into the final rolled product providing that the cast slab is at the proper hot rolling temperature. Alternatively, the cast slab can be reheated to a specific reheating temperature prior to hot rolling.

When the slab or other cast shape is reheated, the temperature can range between about 2100° F. (1149° C.) and 2350° F. (1288° C.). The inventive alloy chemistry is less sensitive to the slab reheating temperature than prior art chemistries that require tight reheating temperature control to avoid the development of coarse austenite and ferrite grain sizes.

Figure 1B:
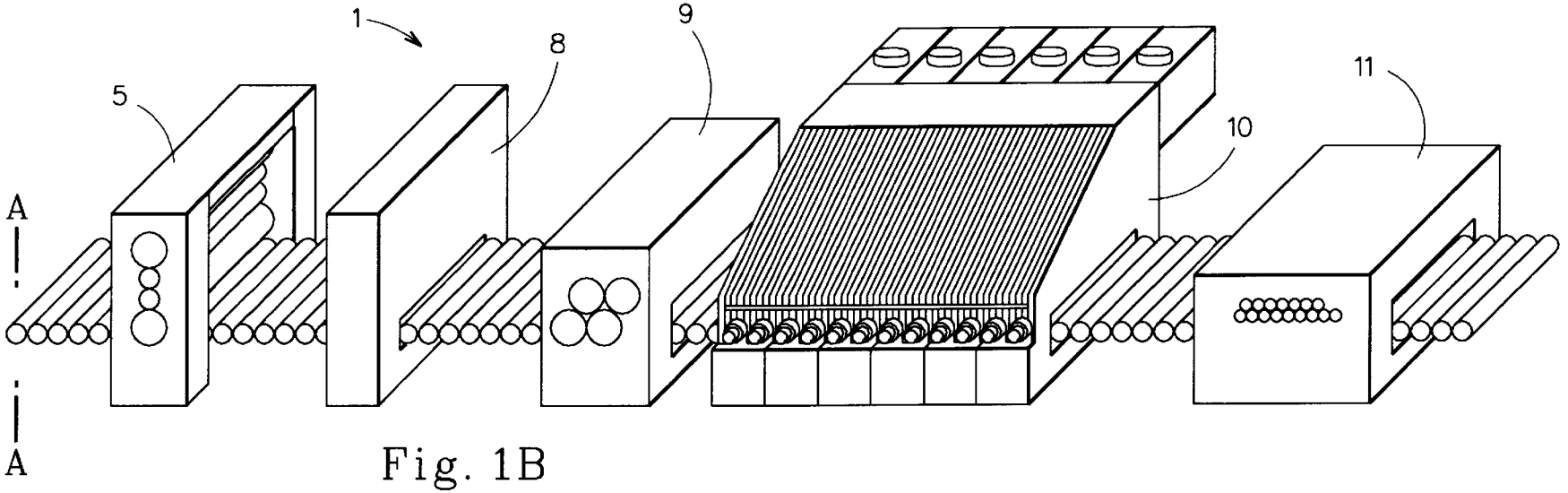
FIG. 1B shows a second portion of a typical hot rolling mill capable of manufacturing plate product according to the invention.

The remaining description of the processing is described with respect to a particular rolling mill configuration. However, it should be understood that other rolling mill configurations can be used to carry out a sequence of rolling steps without departing from the scope of this invention. Referring to FIGS. 1A and 1B of the drawings, once the slab is reheated, it is first hot rolled as well known in the art, and then the slab is control rolled to produce a finished product having desired properties, as rolled. The hot rolling mill 1 typically includes either a batch furnace 2 or a continuous furnace 3 that feeds cast shapes to the rolling mill. A world class plate mill comprises a descaler box 6 downstream of the reheating furnaces, a two-high hot rolling stand 4 for rough rolling the slab, an interstand cooling station 7, a four-high finishing stand 5 to control roll the partially rolled slab, an isotope thickness gauge 8 and a preleveler 9. As described in greater detail below, an accelerated cooling unit 10 is situated downstream of the preleveler, and the finished plate product exits the rolling mill 1 through a final hot leveler shown at 11.

The inventive method uses several variables to control the hot rolling, sequence described above. Some of the control variables used include slab reheat temperature (SRT), measurement at either the batch or continuous furnace; mill entry temperature (MET) measurement just upstream of the two-high hot rolling stand 4; and measurement of both the partially-rolled slab transfer thickness ($t_2$) and temperature prior to its entry into the four-high mill stand 5. During the controlled rolling step in the four-high mill stand 5, intermediate slab thickness ($t_3$) and intermediate temperature, corresponding to the partially-rolled plate thickness, are also monitored and used to measure and control percent reduction to final plate product thickness ($t_4$). And finally, finish or discontinue rolling temperature (FRT) is measured just downstream of the four-high stand.

Figure 2:
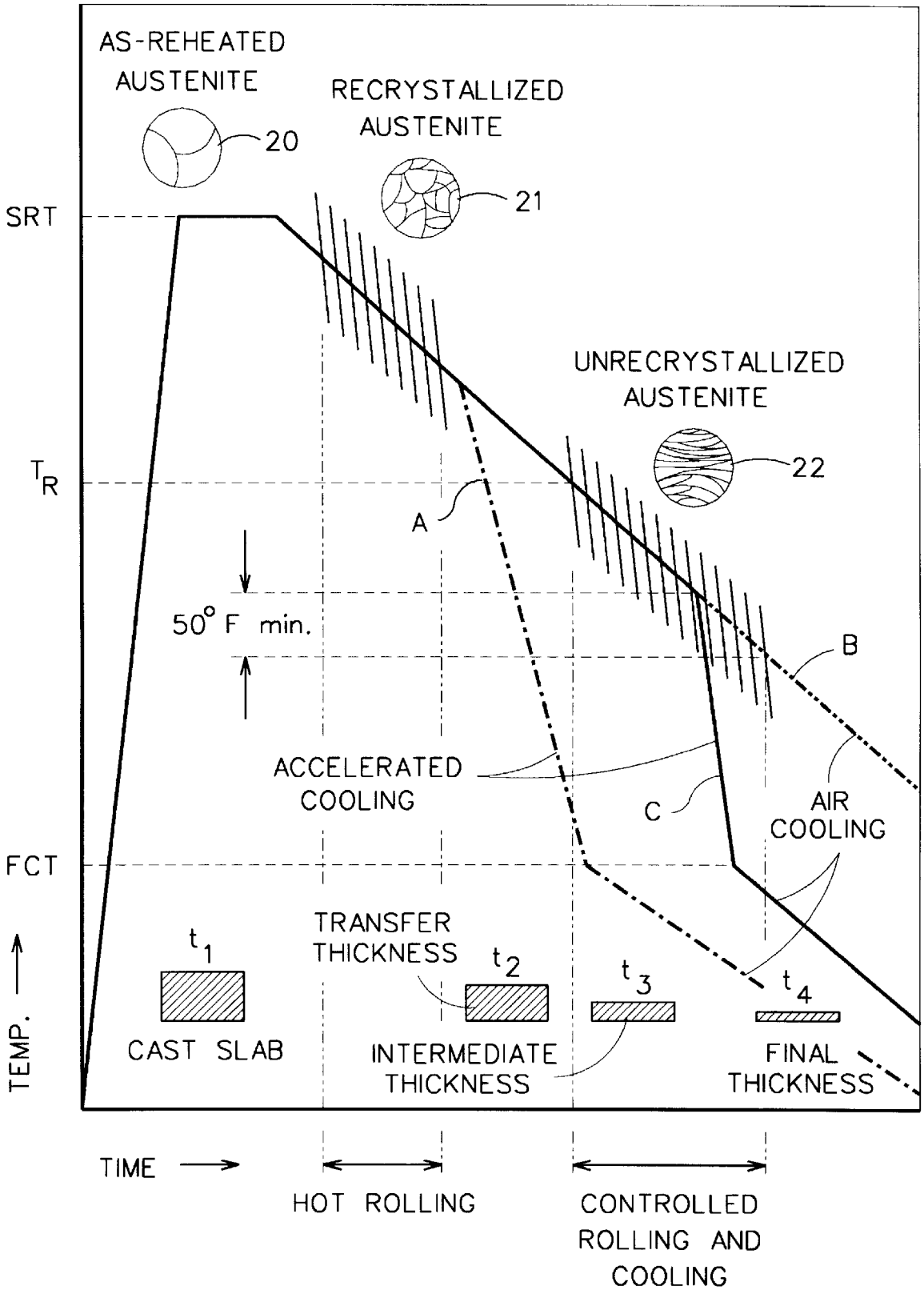
FIG. 2 compares rolling steps to the invention with prior rolling practice.

Referring again to FIGS. 1A–1B, and also to FIG. 2, a cast slab or shape comprising the inventive alloy chemistry is shown being rolled by rolling sequence "C" in FIG. 2. The continuously cast slab enters the rolling mill 1 at a cast slab thickness $t_1$, and a SRT between 2100°–2350° F. At such elevated SRT levels, austenite grains can be relatively coarse (i.e., equal to or greater than about 100 $\mu$m). This is schematically represented as 20 in FIG. 2. The slab is sent through the descaler box 6 for descaling prior to its entry into the two-high mill stand 4 where it is hot rolled within a temperature range that causes austenite grain refinement through recrystallization shown at 21 in FIG. 2. During the hot rolling step, the slab is reduced to a thickness $t_2$ suited for entry into the four-high mill stand 5. If required, the partially-rolled slab can be cooled at the interstand cooling unit 7 prior to controlled rolling in the four-high stand. The hot rolled slab enters mill stand 5 at about or below the recrystallization (stop) temperature for austenite ($T_R$). This is done in order to control austenite recrystallization during the controlled rolling step.

While the hot rolling step involves rolling the slab above $T_R$, the control rolling step entails at least some rolling below the $T_R$ temperature level. Above $T_R$ the austenite grain size is refined through recrystallization after each rolling pass. Below $T_R$, the austenite grains are flattened or pancaked (unrecrystalized, 22 in FIG. 2), during the rolling passes. This provides additional nucleation sites for phase transformation that leads to microstructure refinement.

As heretofore stated, the hot rolled slab is transferred from mill stand 4 at a thickness $t_2$ to mill stand 5 where controlled rolling to the finish thickness $t_4$ occurs. The slab is first rolled to an intermediate thickness, $t_3$. During the controlled rolling the partially rolled plate is further reduced from an intermediate thickness $t_3$ to final thickness $t_4$ (total reduction). Temperature and percent slab reduction are closely monitored, controlled and correlated during the total reduction in order to manufacture a final plate product having desired properties in the as-rolled condition. As successive roll passes take place in the four-high stand, the plate thickness is measured in the isotope thickness gauge 8, or by any other suitable measuring device. When gauge 8 measures a $t_4$ selected in a range between 0.4 to 1.50 inches, the plate is sent to pre-leveler 9 and then immediately accelerated cooled in a water spray, or a spray mixture of water and air, within the accelerated cooling unit 10.

The accelerated cooling involves cooling either partially or entirely through the phase transformation regime to a finish cooling temperature (FCT), usually about 1050° F. (565° C.). The finished plate is then air cooled to ambient temperature. The higher cooling rate during accelerated cooling, as compared to the prior rolling practice shown by rolling sequence "B", produces a refined ferrite/pearlite microstructure over a shorter time period than achieved in the past. This is attributed to a depression in the ferrite-start and pearlite-start transformation temperatures caused by the higher cooling rate. Some bainite and/or martensite may also be introduced by accelerated cooling. Tests conducted on plate product produced according to the steps shown in sequence "C" show that the finished plate product has a minimum yield strength of 65 ksi.

As clearly presented in FIG. 2, rolling practices, as shown by sequences "A" and "B", have failed to recognize the heretofore stated advantages gained by the controlled rolling of unrecrystalized austenite in combination with accelerated cooling. Sequence "A" illustrates a typical hot rolling practice where the microstructure of the rolled product is less critical and little or no control rolling takes place. Sequence "B", on the other hand, shows a state-of-the-art rolling practice where refinement of product microstructure is important to achieve desired properties. FIG. 2 clearly shows that the rolling sequence "C" greatly improves productivity over sequence "B" during the controlled rolling step since a higher finish rolling temperature is afforded, and sequence "C" enables the plate product to be cooled at a much higher post rolling cooling rate over the past rolling practice.

Once the material exits the four-high finishing stand and is preleveled, it is subjected to accelerated cooling. The accelerated cooling rate can vary for a given plate thickness. For example, a 20 mm thickness employs a cooling rate ranging from 4° to 30° C./s. In terms of heat flux range, cooling rates can range from 0.35 to 2.0 $MW/m^2$. Although any type of accelerated cooling can be used with the inventive method, a preferred type utilizes upper and lower air/water sprayers directed against the control rolled material as the material travels through the sprayers. In addition, a moist air collecting duct can be positioned adjacent to each upper sprayer to collect any residual air/water mist which may effect the desired controlled cooling. Once the rolled product is subjected to accelerated cooling, it can then be hot leveled and processed depending on its desired end use.

While the rolling practice may vary depending on the type of material, final thickness and the like, a preferred rolling practice for the invention is as follows: the four-high finishing mill entry temperature can be as high as about 1975° F. (1079° C.); the intermediate temperature can range between about 1625° F. (885° C.) and about 1775° F. (968° C.); the finish rolling temperature can range between about 1400° F. (760° C.) and 1650° F. (899° C.); the total reduction in plate thickness measured when using the plate thickness at the intermediate temperature can range between about 45 to 75%; the slab transfer thickness to product thickness ratio T/F, where T equals slab transfer thickness measured between the two-high and four-high mill stands ($t_2$) and F equals finish product thickness ($t_4$), can range from about 2.0 to 6.0. For example, a T/F ratio of 4.0 for a 1" thick final thickness plate equates to a transfer thickness of 4.0". For a 0.5" plate and a ratio of 5.6, the transfer thickness would be 2.8".

Once the plate leaves the hot rolling mill, it is subjected to accelerated cooling. That is, the plate is cooled to a temperature range between about 875° to 1200° F. (468° to 649° C.). The start cooling temperature can range between about 1350° to 1550° F. (732° to 843° C.). The cooling rate in terms of heat flux can range between 0.35 and 2.0 $MW/m^2$. For each product thickness, there is a range of acceptable and achievable cooling rates. For example, a 13 mm thick plate can be cooled within the range of about 6° to 40° C./sec. Similarly, a 25 mm thick plate can be cooled within a range of about 4° to 26° C./sec. Once the plate reaches the finish cooling temperature, e.g., leaves the cooling unit, it can be air cooled.

By using the alloy chemistry, controlled rolling and accelerated cooling, the finishing rolling temperatures of the plates can be raised by about 50° to 150° F. (28° to 83° C.). Using these higher finishing rolling temperatures improves the mill productivity by about 20 to 35% based on laboratory rolling times. The 63M alloy chemistry provides these benefits as well as improved castability, formability and weldability. Moreover, it is less sensitive to the slab reheating temperature.

For the Alloy 63M chemistry, an optimum composition and rolling practice is as follows:

0.5" plates:

2300° F./5.6 t/1950° F./1750° F./1600° F./60%/accelerated cooling (AC).

1" plates:

2300° F./4 t/1875° F./1750° F./1550° F./70%/AC.

This practice relates to slab reheating temperature, the transfer thickness to product thickness ratio, the finishing mill entry temperature, the intermediate temperature, the finish rolling temperature, the total reduction below the intermediate temperature and the type of cooling, respectively.

In order to demonstrate that the inventive alloy chemistry and processing meet minimum mechanical properties, particularly for ASTM A572 Grade 65, while improving mill productivity, investigations were conducted relating to slab reheat temperature (SRT), % reduction below the intermediate temperature (IT), finish rolling temperature (FRT) and finish cooling temperature (FCT). The mechanical properties for the investigation included the ASTM A572 Grade 65 yield strength and tensile strength requirements and a longitudinal Charpy V-notch (CVN) value at −20° F. (−29° C.) of 15-foot pounds minimum (20.3 Joules). It should be understood that the investigation described below is merely exemplary of the invention and the invention is not to be limited by the variables and/or conditions used therein.

EXPERIMENTAL PROCEDURE

Eight 500 lb. (227 kg) experimental heats were vacuum-induction melted using Armco iron and cast into ingot molds measuring about 8.5" (216 mm) by 20" (508 mm) long. Two ingots, each representing a separate heat, were cast of grades (0.12C—Nb—V) ("62"), low-C version (0.08C—Nb—V) ("62M") and the preferred grades "63" and "63M" comprising the alloy chemistries: (0.12C—Nb—V—Ti) ("63"); and a low-C chemistry version (0.08C—Nb—V—Ti), ("63M"). All heats contain a low Si level (0.04%) to provide improved galvanizing properties. The aim and product analysis for each ingot are listed in Table 2, the analyses being generally in good agreement for a given grade.

PLATE PROCESSING

Each of the ingots was first soaked in a muffle furnace at 2300° F. (1260° C.) for three hours, and hot rolled to either 4" (114.3 mm) thick by 5" (127 mm) wide billets (for subsequent rolling to (12.7 mm) plates), or 6" (152.4 mm) thick by 5" (127 mm) wide billets (for subsequent rolling to 1" (25.4 mm) plates). Small pieces were then cut off each billet, reheated to 1260° C. or 1170° C. (for some of the 25.4 mm plates) and control rolled to ½" or 1" plates (12.7 or 25.4 mm plates). Several plates were produced using the similar controlled rolling conditions and air cooling to provide the basis for comparison with the accelerated cooled (AC) plates. The processing parameters of these conventional air-cooling practices are summarized in Table 3.

For the simulated AC plates, the primary processing variables were the slab reheating temperature (SRT), total reduction below the intermediate temperature (IT), and finish rolling temperature (FRT). The range of processing parameters investigated for various plate thickness are summarized in Table 4 in English units. Immediately after the last rolling pass, the plates were either air cooled to room temperature, or accelerated cooled in 2.5% AQUA Quench 110 polymer solution (produced by E. F. Houghton & Co.) to simulate production achievable accelerated cooling rates. The accelerated cooling involved air cooling for 20 seconds after the last rolling pass in order to simulate the transfer time between finish rolling and the start of accelerated cooling in production, followed by horizontally immersing the plate in an aqueous solution containing the 2.5% (by volume) AQUA Quench 110 until a mid-thickness temperature of the plate reached a target set point. Air cooling followed the water/polymer quenching. The quenching solution was not agitated during plate cooling. In some cases, multiple plates were produced to confirm the results.

PLATE TESTING

Duplicate, full thickness, flat-threaded transverse tensile specimens were machined from the 0.5" (12.7 mm) plates, and duplicate 0.505" (12.8 mm) diameter transverse tensile bars were machined from the quarter-thickness location of the 1.0" (25.4 mm) plates. Three longitudinal, full-size Charpy V-notch (CVN) specimens were removed from each plate, and tested at −20° F. (−29° C.). In addition, ten additional longitudinal CVN specimens were tested for selected plates to develop full transition curves. For metallographic examination, one-inch square specimens were cut from each plate and polished on a longitudinal through-thickness face. The specimens were sequentially etched in 4% picral and 2% nital solutions for phase differentiation, and examined in a light microscope.

RESULTS AND DISCUSSION 0.5" (12.7 mm) THICK PLATE

Metallography

The microstructure of the air cooled Alloy 63 plate having a finish rolling temperature of 1525° F. (829° C.) had a mixture of ferrite and pearlite. In comparison, the microstructure of the accelerated cooled Alloy 63 plate having a finish rolling temperature of 1600° F. (871° C.) exhibited ferrite, bainite and some martensite. The Alloy 63M plate had a similar structure to the Alloy 63 plate in the air cooled condition except that there was more ferrite and less pearlite. As expected, the accelerated cooled Alloy 63M plate had more ferrite than the accelerated cooled Alloy 63 plate.

Effect of FRT and Total Reduction Below IT

Figure 3:
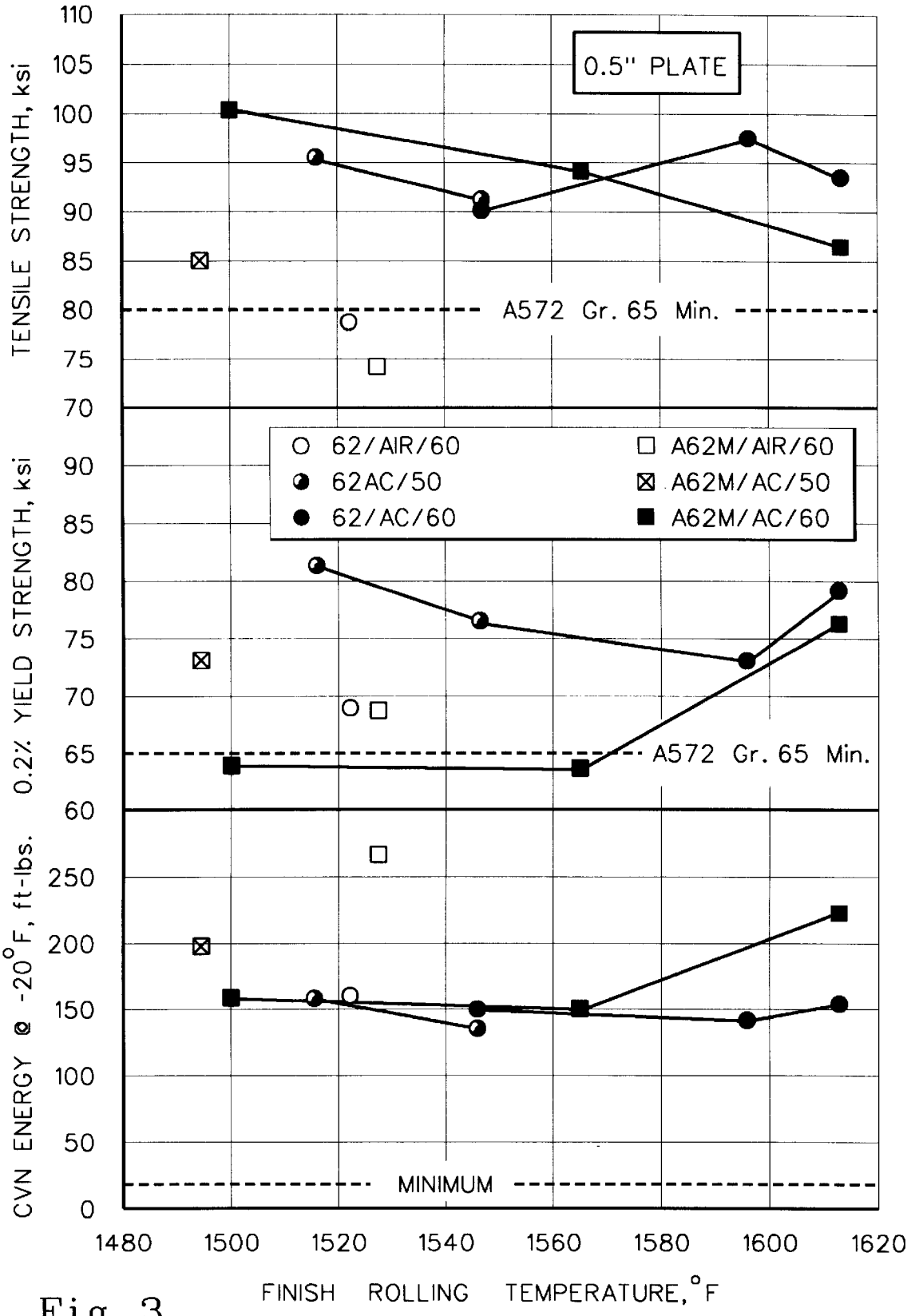
FIG. 3 compares tensile strength, yield strength and CVN energy as a function of finish temperature for prior art alloy chemistries.

The mechanical properties and processing data of the 0.5" (12.7 mm) thick plates are presented in Table 5. The tensile strength, (0.2% yield strength, and CVN energy at −20° F. (−29° C.) of the 62 and 62M plates are plotted as a function of finish rolling temperature in FIG. 3. The completely open symbols represent the air-cooled plates and the others represent AC plates. FIG. 3 shows both air cooled plates have inadequate tensile strength values, the 62M plate having the lower tensile strength of 75 ksi (519 MPa), a result of its lower carbon content. There is no significant effect of FRT and total reduction below the IT on the tensile strength, yield strength, and CVN energy at −20° F. (−29° C.) for the AC plates. A good balance of mechanical properties can be obtained by any combination of the FRT and reduction evaluated. Note that there are two accelerated cooled 62M plates exhibiting low yield strength values (due to continuous yielding).

Figure 4:
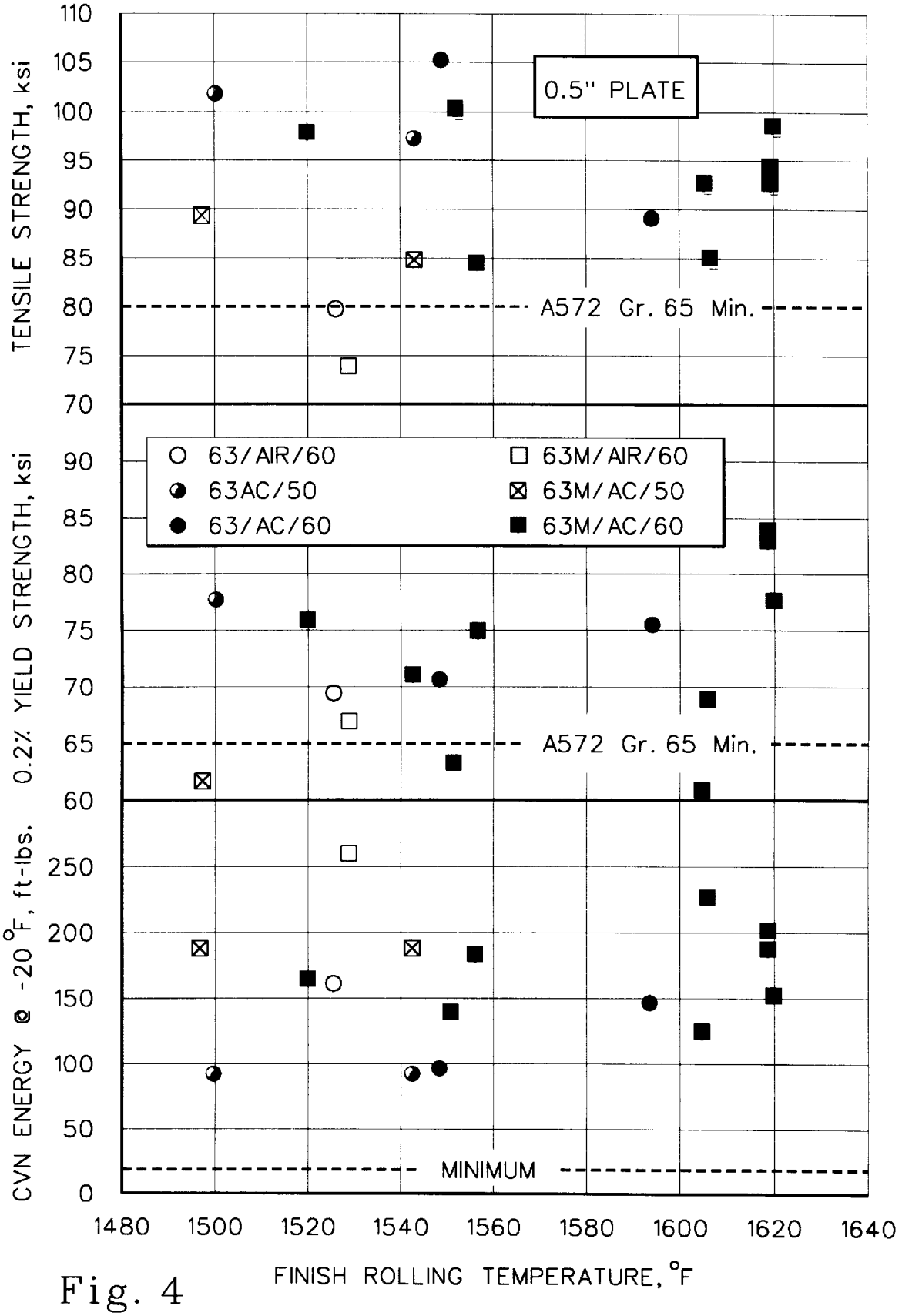
FIG. 4 compares tensile strength, yield strength and CVN energy for the preferred alloy chemistries and processing.

The tensile strength, yield strength, and CVN energy at −20° F. (−29° C.) of the Alloy 63 and Alloy 63M are plotted as a function of FRT in FIG. 4. Similar to the 62 and 62M grades, the air cooled Alloy 63 and Alloy 63M plates also exhibit marginal tensile strength. Again, there is no clear effect of FRT or reduction on the mechanical properties of the AC plates. Most of the AC plates meet the mechanical property requirements, except for three plates (due to continuous yielding).

Figure 5:
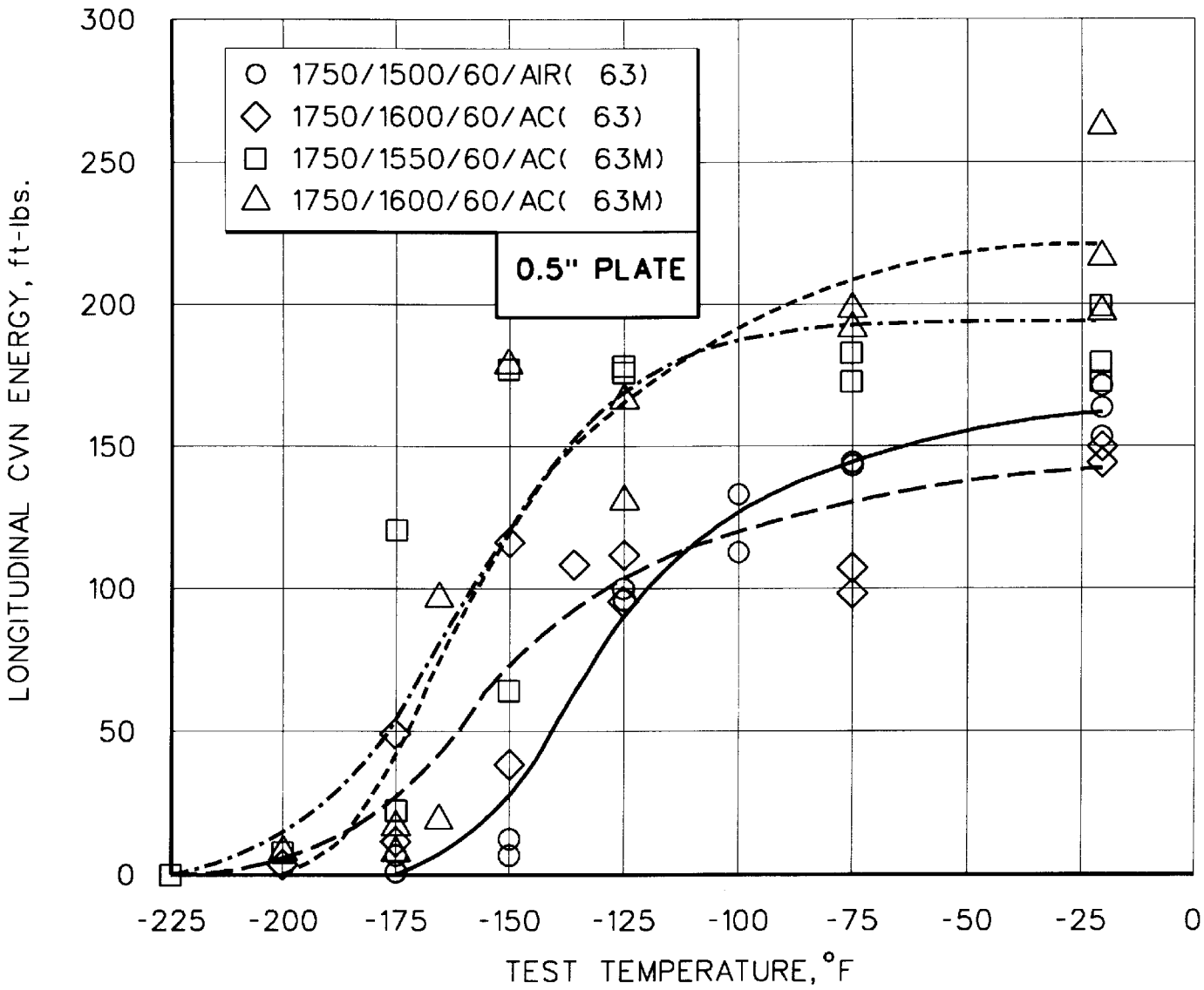
FIG. 5 compares CVN energy for air cooled or accelerated cooled plates.

The CVN energy transition curves of some selected Alloy 63 and Alloy 63M plates are shown in FIG. 5. The Alloy 63 plates have fairly good toughness in both the accelerated cooled and air cooled conditions. In comparison, the accelerated cooled, low-C Alloy 63M plates exhibit even better toughness than the Alloy 63 plates.

Effect of FCT

Figure 6:
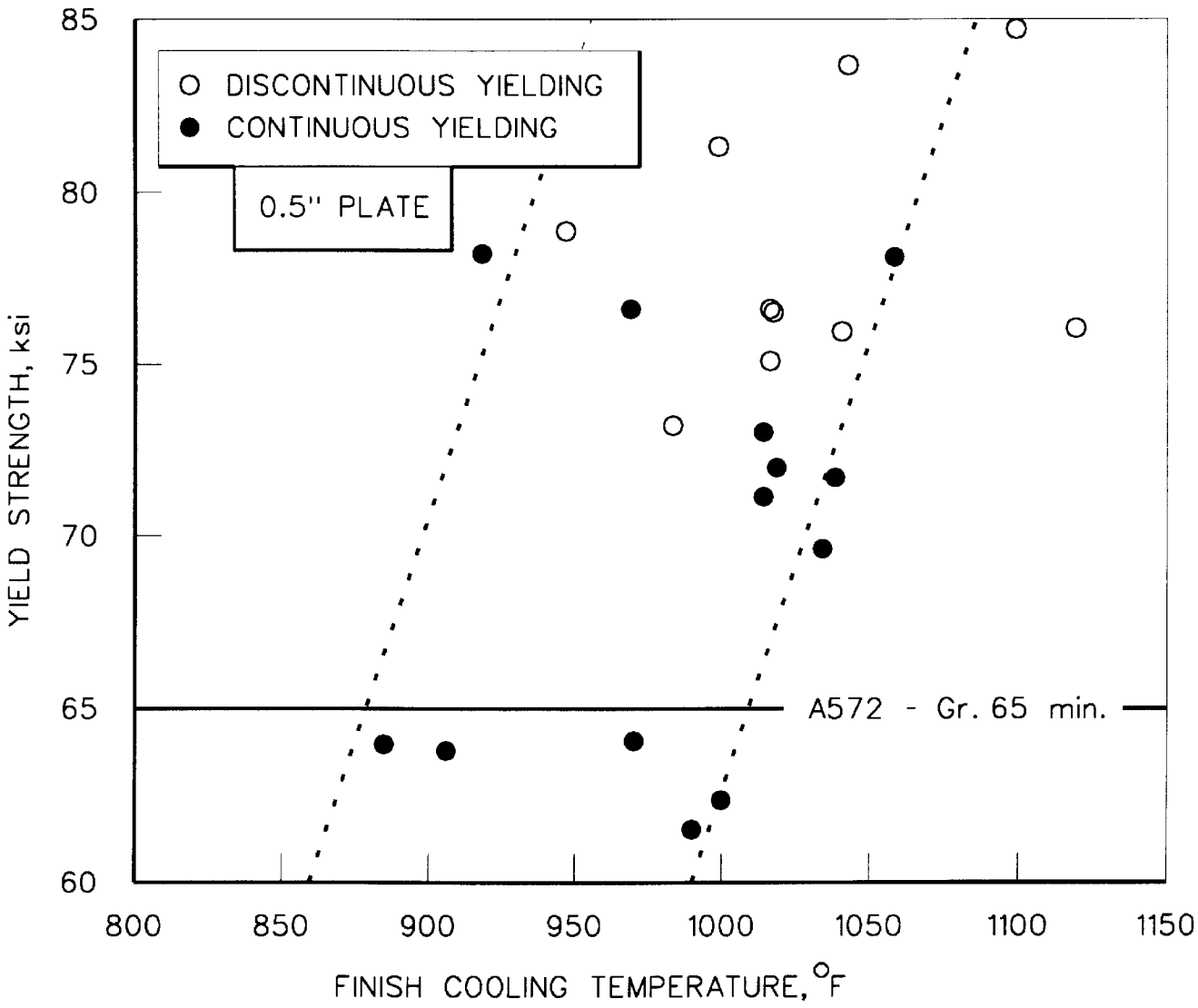
FIG. 6 compares yield strength and finish cooling temperature for 0.5" thick plates.

Since there are a number of plates exhibiting subpar yield strength (65 ksi (450 MPa) minimum YS required), it was suspected that these plates were finish cooled too low during AC simulation. A low FCT can cause an excessive amount of martensite, and hence continuous yielding behavior and low yield strength. The FCTs for the 0.5" (12.7 mm) plates are listed in Table 5 and the yield strength and yielding behavior are plotted as a function of FCT in FIG. 6. This figure shows that continuous yielding can occur with a FCT as high as 1060° F. (571° C.). However, the plates produced with high FCTs (i.e., ≧1015° F. (546° C.)) still show adequate yield strength even with continuous yielding, behavior, presumably due to less martensite formed and a self-tempering effect during the cooling process. In contrast, five plates cooled with a FCT at or below 1000° F. (538° C.) exhibit much lower yield strength.

Figure 7:
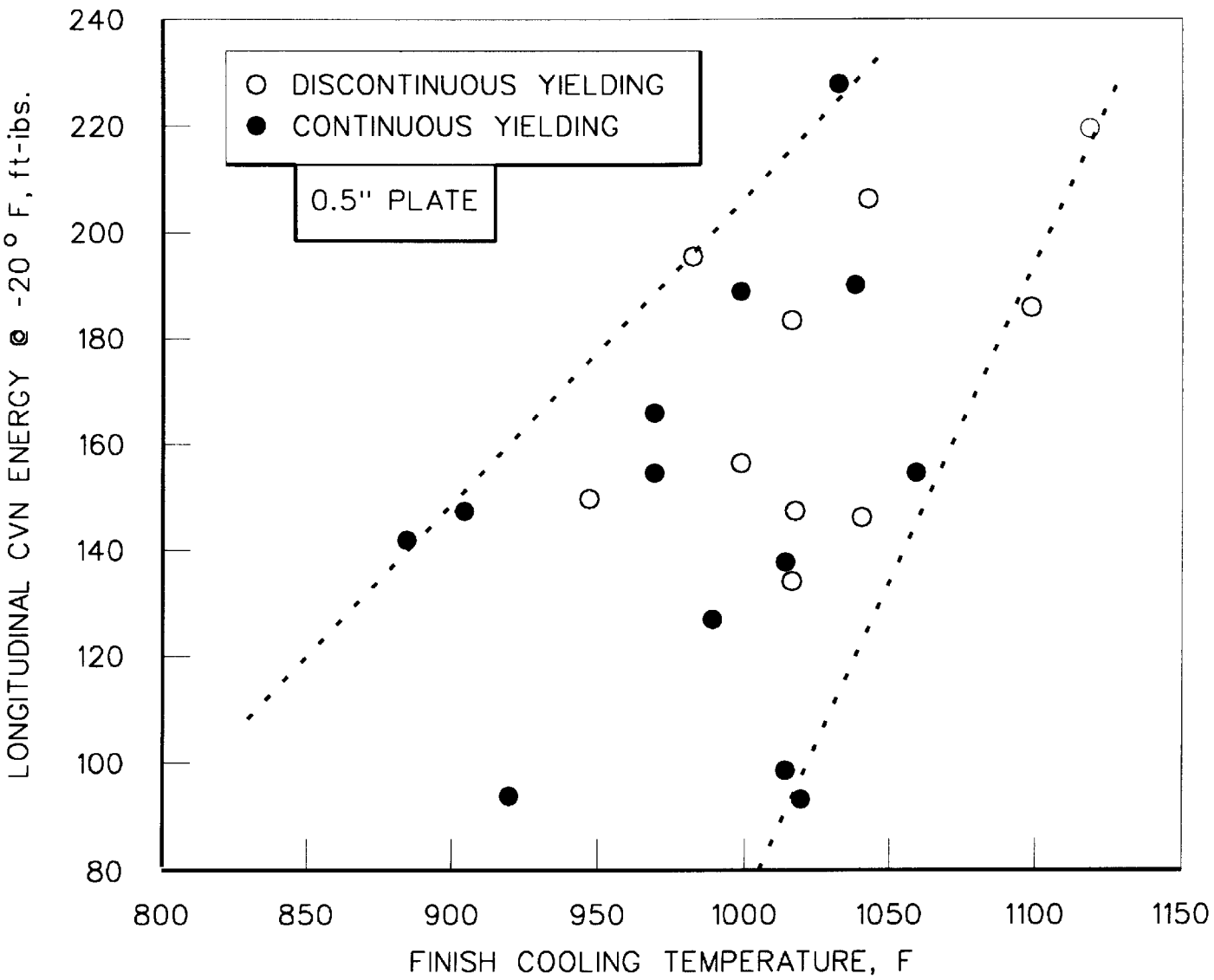
FIG. 7 compares CVN energy and finish cooling temperature for 0.5" thick plates.

The longitudinal CVN energy at −20° F. (−29° C.) of the 0.5" (12.7 mm) plates are plotted against the FCT in FIG. 7. In general, the plates produced with lower FCTs exhibit poorer toughness levels, especially for those containing an excess amount of martensite (as indicated by their continuous yielding behavior). Based on the observation in FIGS. 6 and 7, the aim FCT for 0.5" (12.7 mm) thick plates should be at least 1015° F. (546° C.) to ensure a good yield strength/toughness balance.

Laboratory results show that the FRT and total reduction below the IT do not have significant effects on the mechanical properties of 0.5" (12.7 mm) thick plates for the four compositions evaluated. The low-C, Alloy 63M composition is considered an excellent candidate for pole applications due to its expected improved castability, and good strength and toughness levels. With a reduced carbon level, the Alloy 63M grade is also expected to provide improved formability and weldability. Based on the results of this study, the FRT of the AC plates can be increased by about 100° F. compared to air cooled plates. On the basis of laboratory results, the AC rolling practice provides about a 20% reduction in total rolling times over conventional rolling practice. Since the FRT and reduction below the IT do not have significant effects on mechanical properties, the rolling/cooling practice which provides the highest productivity improvement is considered as optimum. Using the convention established earlier, the optimum composition and rolling practice for 0.5" (12.7 mm)-thick ASTM A572 Grade 65 plates is:

0.08C—Nb—V—Ti (63M), 2300° F./5.6 t/1950° F./1750° F./1600° F./60%

1.0" (25.4 mm) THICK PLATE

Metallography

Similar investigations were performed for 1" (25.4 mm) thick plates. As described above for the 0.5" (12.7 mm) thick plate, the air cooled Alloy 63 plate had a mixture of ferrite and pearlite. With accelerated cooling, the microstructure changed to predominantly ferrite and bainite plus some martensite. The microstructure of the accelerated cooled Alloy 63M plate also contained ferrite, bainite and martensite. There was more ferrite present in the Alloy 63M plate than in the Alloy 63 plate.

Effect of FRT and Total Reduction Below IT

The effect of FRT and total reduction below IT for 1" (25.4 mm) thick plates was similar to that found for the 0.5" (12.7 mm) thick plates. That is, there was no significant effect of FRT and reduction below the IT on the tensile and yield strength and CVN energies of the accelerated cooled 62 and 62M plates. However, the air cooled 62M plate had only marginal tensile strength due to its lower carbon level. In these investigations, a reduced SRT of 2150° F. (1177° C.) for the 62 and 62M compositions was used in order to restrict austenite grain coarsening.

The Alloy 63 and Alloy 63M 1" (25.4 mm) plates exhibit a good balance of strength and toughness which is superior to that of the 62 grade. An accelerated cooling simulation showed that there was no clear effect of FRT and reduction below IT on the mechanical properties of either the Alloy 63 or Alloy 63M plates. The Alloy 63M plates met the mechanical property requirements by using an SRT at either 2150° F. or 2300° F. (1177° C. or 1260° C.). The accelerated cooled Alloy 63M plate exhibits better impact toughness than the Alloy 63 plate when accelerated cooled.

Effect of FCT

The effect of finish cooling temperature for the 1" (25.4 mm) plates was similar to that observed with the 0.5" (12.7 mm) plates. Based on the 1" (25.4 mm) plate investigations, the finish cooling temperature should be at least 975° F. (524° C.) to ensure adequate yield strength and toughness levels for 1" (25.4 mm) thick plate.

In summary, the FRT and reduction below IT do not have a significant effect on the mechanical properties on the accelerated cooled 1" (25.4 mm) plates on any of the compositions evaluated. As a result, the Alloy 63M composition is a prime candidate due to its expected improved castability. In addition, the Alloy 63M grade can be produced using a normal SRT of 2300° F. (1260° C.) and still provide a significant level of toughness. Since the FRT and reduction below IT do not significantly effect the mechanical properties of the accelerated cooled Alloy plates for the ranges examined, the optimum processing can be selected based on the highest productivity improvement. During this laboratory investigation, it was demonstrated that the accelerated cooled alloy 63M plates could be finish rolled at a temperature about 150° F. higher than that used for conventionally controlled rolled and air cooled alloy 63 plate. On the basis of total laboratory rolling time, the accelerated cooling rolling practice provides about 35% improvement in mill productivity over the prior art rolling practice for air cooled Alloy 63 material. The optimum composition and accelerated cooling practice for a 1" (25.4 mm) ASTM A572 Grade 65 plate is:

0.08 C—Nb—V—Ti alloy (63M), 2300° F./4 t/1875° F./1750° F./1550° F./70%.

As such, an invention has been disclosed in terms of preferred embodiments thereof which fulfill each and every one of the objects of the present invention as set forth above and provides a new and improved high-strength low-alloy steel chemistry, method of processing and product.

Various changes, modifications and alterations from the teachings of the present invention may be contemplated by those skilled in the art without departing from the intended spirit and scope thereof. Accordingly, it is intended that the present invention only be limited by the terms of the appended claims.

TABLE 1

| Alloy | C | Mn | P | S | Si | Nb | V | Ti | N | Al |
|---|---|---|---|---|---|---|---|---|---|---|
| High C—V | .16<br>.20 | 1.40<br>1.60 | .03 | .03 | .04 | — | .07<br>.09 | — | — | .005<br>.08 |
| C—Nb—V<br>(Alloy 62) | .11<br>.13 | 1.40<br>1.60 | .03 | .02 | .04 | .03<br>.05 | .07<br>.09 | — | .012 | .005<br>.045 |
| C—Nb—V—Ti | .11<br>.13 | 1.40<br>1.60 | .03 | .02 | .04 | .03<br>.05 | .07<br>.09 | .01<br>.02 | .012 | .005<br>.045 |
| Alloy 63* | .10<br>.14 | 1.40<br>1.60 | .03 | .02 | .04 | .01<br>.05 | .05<br>.10 | .006<br>.020 | .012 | .005<br>.080 |
| Alloy 63M* | .06<br>.10 | 1.40<br>1.60 | .03 | .02 | .04 | .01<br>.05 | .05<br>.10 | .006<br>.020 | .012 | .005<br>.080 |
| ASTM A572-65 | .23 | 1.65 | .04 | .05 | .40 | .05 | .01<br>.15 | — | .015 | — |

1) Limits without ranges or maximums
2) *Denotes composition of invention
3) values are in weight percent

TABLE 2

Steel Compositions Wt. %

| Grade | Heat No. | C | Mn | P | S | Si | Ni | Cr | Mo | Cu | Al | V | Nb | N | Ti |
|---|---|---|---|---|---|---|---|---|---|---|---|---|---|---|---|
| 62 | Aim | 0.12 | 1.5 | 0.017 | 0.008 | 0.04 | 0.03 | 0.04 | 0.01 | 0.02 | 0.035 | 0.08 | 0.04 | 0.007 | |
| 0.12C-Nb-V | Product | 0.12 | 1.45 | 0.018 | 0.008 | 0.04 | 0.031 | 0.043 | 0.01 | 0.019 | 0.03 | 0.071 | 0.038 | 0.011 | 0.002 |
| 62M | Aim | 0.08 | 1.5 | 0.017 | 0.008 | 0.04 | 0.03 | 0.04 | 0.01 | 0.02 | 0.035 | 0.08 | 0.04 | 0.007 | |
| 0.08C-Nb-V | Product | 0.073 | 1.4 | 0.016 | 0.008 | 0.04 | 0.031 | 0.042 | 0.012 | 0.022 | 0.031 | 0.077 | 0.038 | 0.0084 | 0.002 |

TABLE 2-continued

| Grade | Heat No. | C | Mn | P | S | Si | Ni | Cr | Mo | Cu | Al | V | Nb | N | Ti |
|---|---|---|---|---|---|---|---|---|---|---|---|---|---|---|---|
| | | | Steel Compositions Wt. % | | | | | | | | | | | | |
| 63 | Aim | 0.12 | 6 1.5 | 0.017 | 0.008 | 0.04 | 0.03 | 0.04 | 0.01 | 0.02 | 0.035 | 0.08 | 0.04 | 0.007 | 0.012 |
| 0.12C-Nb-V-Ti | Product | 0.12 | 1.47 | 0.018 | 0.009 | 0.04 | 0.031 | 0.042 | 0.012 | 0.02 | 0.031 | 0.081 | 0.039 | 0.0078 | 0.014 |
| 63M | Aim | 0.08 | 1.5 | 0.017 | 0.008 | 0.04 | 0.03 | 0.04 | 0.01 | 0.02 | 0.035 | 0.08 | 0.04 | 0.007 | 0.012 |
| 0.08C-Nb-V-Ti | Product | 0.086 | 1.45 | 0.016 | 0.008 | 0.03 | 0.03 | 0.042 | 0.011 | 0.02 | 0.028 | 0.076 | 0.043 | 0.0078 | 0.013 |

TABLE 3

Summary of Conventional Controlled Rolling and Air Cooling Practices

| Grade | Plate t, in. | Rolling Practice* (°C.) |
|---|---|---|
| 62, 62M 63, 63M | 0.5 | 2300°/5.6t/1950° F./1750° F./1500° F./60% |
| 62, 62M | 1.00 | 2150° F./4t/1875° F./1650° F./1400° F./70% |
| 63 | 1.00 | 2300° F./4t/1875° F./1650° F./1400° F./70% |

*The rolling practice is summarized in terms of: slab reheating temperature/transfer thickness to product thickness ratio/four-high mill entry temperature/intermediate temperature/finish rolling temperature/total reduction below the intermediate temperature.

TABLE 4

Summary of Processing Parameters

| Plate t | Grade | Composition | Slab Dimensions, Inches | Slab Reheat Temperature, °F. | Range of % Red Below Intermediate Temp. | Range of FRT, °F. |
|---|---|---|---|---|---|---|
| ½ Inch | 62 | 0.12C-Nb-V | 4.5 × 5 × 4 | 2300 | 50 to 60 | 1490 to 1620 |
| | 62M | 0.08C-Nb-V | | | | |
| | 63 | 0.12C-Nb-V-Ti | | | | |
| | 63M | 0.08C-Nb-V-Ti | | | | |
| 1 Inch | 62 | 0.12C-Nb-V | 6 × 5 × 4.5 | 2150 or 2300 | 50 to 70 | 1400 to 1560 |
| | 62M | 0.08C-Nb-V | | | | |
| | 63 | 0.12C-Nb-V-Ti | | | | |
| | 63M | 0.08C-Nb-V-Ti | | | | |

TABLE 5

Summary of Processing and Mechanical Property Data for the 0.5 Inch Thick Plates

| Grade | 0.2% YS ksi | UTS ksi | % Elong. | % RA | CVN En @ −20° F. ft-lbs. | SRT °F. | Transfer t, inch | Transfer Temp., °F. | Int. Temp. °F. | % Red | FRT °F. | SCT °F. | FCT °F. | CR °F/sec | Rolling Time min |
|---|---|---|---|---|---|---|---|---|---|---|---|---|---|---|---|
| A 62 | 68.9 | 79.2 | 31.5 | 65.8 | 157 | 2300 | 2.8 | 1950 | 1750 | 60 | 1522 | — | — | 2⊕ | 4.50 |
| A 62 | 76.5 | 90.4 | 23.8☆ | 63.2 | 147 | 2300 | 2.8 | 1950 | 1750 | 60 | 1546 | 1480 | 1019 | 39.3 | 3.77 |
| AC | 72.9* | 97.1 | 14.3☆ | 59.4 | 137 | 2300 | 2.8 | 1950 | 1750 | 60 | 1596 | 1530 | 1015 | 22.5 | 3.85 |
| Plates | 78.9 | 93.2 | 24.3 | 58.7 | 149 | 2300 | 2.8 | 1950 | 1750 | 60 | 1613 | 1515 | 948 | 50.4 | |
| | 81.3 | 95.3 | 23.0 | 59.9 | 156 | 2300 | 2.8 | 1950 | 1750 | 50 | 1515 | 1455 | 1000 | 44.1 | 4.25⊕ |
| | 76.6 | 91.2 | 26.3 | 62.4 | 133 | 2300 | 2.8 | 1950 | 1750 | 50 | 1546 | 1490 | 1018 | 45.8 | 3.95 |
| A 62M | 68.7 | 74.7 | 36.3 | 71.0 | 265 | 2300 | 2.8 | 1950 | 1750 | 60 | 1527 | — | — | 2⊕ | 4.27 |
| A 62M | 63.9* | 100.3 | 27.5☆ | 61.6 | 154 | 2300 | 2.8 | 1950 | 1750 | 60 | 1500 | 1440 | 970 | 29.5 | 4.30 |
| AC | 63.6* | 93.9 | 14.8☆ | 65.5 | 147 | 2300 | 2.8 | 1950 | 1750 | 60 | 1565 | 1478 | 906 | 31.6 | 3.96⊕ |
| Plates | 76.1 | 86.1 | 29.5 | 66.9 | 220 | 2300 | 2.8 | 1950 | 1750 | 60 | 1613 | 1517 | 1120 | 38.5 | |
| | 73.2 | 85.1 | 27.3 | 70.5 | 196 | 2300 | 2.8 | 1950 | 1750 | 50 | 1494 | 1450 | 984 | 33.1 | 4.48 |
| 63 | 70.1 | 79.8 | 33.5 | 64.8 | 163 | 2300 | 2.8 | 1950 | 1750 | 60 | 1525 | — | — | 2⊕ | 4.52 |
| 63 AC | 71.0* | 105.9 | 16.0☆ | 54.8 | 98 | 2300 | 2.8 | 1950 | 1750 | 60 | 1548 | 1480 | 1015 | 26.8 | 3.88 |

TABLE 5-continued

Summary of Processing and Mechanical Property Data for the 0.5 Inch Thick Plates

| Grade | 0.2% YS ksi | UTS ksi | % Elong. | % RA | CVN En @ −20° F. ft-lbs. | SRT °F. | Transfer t, inch | Transfer Temp., °F. | Int. Temp. °F. | % Red | FRT °F. | SCT °F. | FCT °F. | CR °F/sec | Rolling Time min |
|---|---|---|---|---|---|---|---|---|---|---|---|---|---|---|---|
| Plates | 76.0 | 90.0 | 23.3 | 61.2 | 146 | 2300 | 2.8 | 1950 | 1750 | 60 | 1594 | 1520 | 1042 | 29.1 | 3.65 |
| | 78.2* | 102.5 | 18.3☆ | 57.7 | 93 | 2300 | 2.8 | 1950 | 1750 | 50 | 1499 | 1445 | 920 | 38.1 | 4.28 |
| | 71.9* | 97.9 | 18.0☆ | 59.3 | 92 | 2300 | 2.8 | 1950 | 1750 | 50 | 1542 | 1475 | 1020 | 23.7 | 3.68 |
| 63M | 67.5 | 74.0 | 36.3 | 70.5 | 265 | 2300 | 2.8 | 1950 | 1750 | 60 | 1528 | — | — | 20⊕ | 4.26⊕ |
| 63M | 76.6* | 98.3 | 20.8☆ | 60.5 | 166 | 2300 | 2.8 | 1950 | 1750 | 60 | 1520 | 1420 | 970 | 30.0 | 3.95 |
| AC | 75.1 | 84.9 | 29.3 | 67.7 | 184 | 2300 | 2.8 | 1950 | 1750 | 60 | 1556 | 1480 | 1018 | 32.9 | 3.78 |
| Plates | 63.8* | 100.3 | 29.0 | 60.7 | 141 | 2300 | 2.8 | 1950 | 1750 | 60 | 1551 | 1472 | 885 | 28.7 | 3.57 |
| | 69.4* | 86.1 | 23.0☆ | 67.7 | 228 | 2300 | 2.8 | 1950 | 1750 | 60 | 1606 | 1520 | 1035 | 25.9 | 3.62 |
| | 61.4* | 93.6 | 18.0☆ | 61.8 | 126 | 2300 | 2.8 | 1950 | 1750 | 60 | 1605 | 1510 | 990 | 27.7 | 3.28 |
| | 78.1* | 99.2 | 24.3☆ | 63.6 | 154 | 2300 | 2.8 | 1950 | 1750 | 60 | 1620 | 1490 | 1060 | 24.8 | 3.32 |
| | 84.7 | 95.1 | 28.3 | 60.3 | 186 | 2300 | 2.8 | 1950 | 1750 | 60 | 1619 | 1490 | 1100 | 26.8 | 3.43 |
| | 83.6 | 93.3 | 24.3☆ | 62.9 | 206 | 2300 | 2.8 | 1950 | 1750 | 60 | 1619 | 1485 | 1045 | 22.4 | 3.35 |
| | 62.2* | 90.5 | 25.3☆ | 67.0 | 189 | 2300 | 2.8 | 1950 | 1750 | 50 | 1496 | 1440 | 1000 | 22.7 | 4.03 |
| | 71.6* | 84.8 | 28.3 | 70.7 | 190 | 2300 | 2.8 | 1950 | 1750 | 50 | 1542 | 1470 | 1040 | 20.4 | 3.80 |

*Continuous Yielding
560 Broke Near Gage Marks
61 Estimated

We claim:

1. An alloy steel plate having a plate composition consisting of alloying elements of carbon, manganese, titanium, niobium, vanadium and nitrogen, elements of phosphorus, copper, nickel, molybdenum, chromium and sulfur, and aluminum as a killing element in amounts, in weight percent, as follows:

carbon between about 0.06 and less than 0.14%;

manganese between 1.00 and 2.00%;

silicon up to 0.04%;

niobium between 0.03 and 0.05%;

titanium between 0.006 and 0.02%;

vanadium between 0.05 and 0.10%;

nitrogen up to 0.012%;

aluminum between 0.005 and 0.08%;

phosphorus up to 0.03%;

sulfur up to 0.02%;

about 0.02% copper, about 0.03% nickel, about 0.01 molybdenum and about 0.04% chromium; and the titanium to nitrogen weight ratio is less than 3.4 to 1; and wherein the balance of the composition is iron and incidental impurities, the plate having a minimum of 450 MPa of yield strength and a minimum of 550 MPa of tensile strength.

2. The plate of claim 1, wherein the niobium ranges between about 0.04 and 0.05% and the nitrogen ranges between about 0.008 and 0.012%.

3. The plate of claim 1, wherein the nitrogen ranges between about greater than 0.007 and 0.012%.

4. The plate of claim 1, wherein titanium ranges between about 0.010 and 0.014%.

5. The plate of claim 1, wherein carbon ranges between about 0.07 and 0.09%.

6. The plate of claim 1, wherein manganese ranges between about 1.40 and 1.60%.

7. The plate of claim 1, wherein the plate has planar upper and lower surfaces arranged between opposing edges.

8. The plate of claim 1, wherein titanium ranges between about 0.010 and 0.014%, carbon ranges between about 0.07 and 0.09% and manganese ranges between about 1.40 and 1.60%.

* * * * *